US011489262B1

(12) United States Patent
Kralj et al.

(10) Patent No.: US 11,489,262 B1
(45) Date of Patent: Nov. 1, 2022

(54) RADIATOR HAVING A RIDGED FEED STRUCTURE

(71) Applicant: Raytheon Company, Waltham, MA (US)

(72) Inventors: David R. Kralj, Marlborough, MA (US); Gregory M. Fagerlund, Peabody, MA (US); Dennis W. Mercier, Hudson, MA (US); Anthony P. Hopf, Sudbury, MA (US); Richard H. Holden, Maynard, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 17/108,108

(22) Filed: Dec. 1, 2020

(51) Int. Cl.

| | |
|---|---|
| ***H01Q 1/40*** | (2006.01) |
| ***H01Q 9/04*** | (2006.01) |
| ***H01Q 21/00*** | (2006.01) |
| ***H01Q 21/06*** | (2006.01) |
| ***H01Q 1/02*** | (2006.01) |

(52) U.S. Cl.
CPC ..... *H01Q 9/0457* (2013.01); *H01Q 1/02* (2013.01); *H01Q 1/405* (2013.01); *H01Q 9/0414* (2013.01); *H01Q 21/0006* (2013.01); *H01Q 21/0087* (2013.01); *H01Q 21/065* (2013.01)

(58) Field of Classification Search
CPC ..... H01Q 9/0457; H01Q 9/0414; H01Q 1/02; H01Q 1/405; H01Q 21/0006; H01Q 21/0087; H01Q 21/065
See application file for complete search history.

(56) References Cited

U.S. PATENT DOCUMENTS

| | | | | |
|---|---|---|---|---|
| 6,624,792 | B1 | 9/2003 | Chu et al. | |
| 8,810,448 | B1 | 8/2014 | Ellsworth et al. | |
| 2003/0067410 | A1 * | 4/2003 | Puzella ..... | H01Q 21/0087 343/700 MS |

FOREIGN PATENT DOCUMENTS

| | | | | |
|---|---|---|---|---|
| CN | 201540963 | U * | 8/2010 | ..... H01Q 13/04 |
| CN | 109546360 | A * | 3/2019 | ..... H01Q 1/36 |
| CN | 111129763 | A * | 5/2020 | ..... H01Q 1/38 |
| CN | 111384597 | A * | 7/2020 | ..... H01Q 15/24 |
| WO | WO-2019197810 | A1 * | 10/2019 | ..... H01P 1/06 |
| WO | WO-2020194270 | A1 * | 10/2020 | ..... H01P 1/165 |

* cited by examiner

*Primary Examiner* — Hoang V Nguyen
(74) *Attorney, Agent, or Firm* — Daly Crowley Mofford & Durkee, LLP

(57) ABSTRACT

Methods and apparatus for a radiator assembly having a feed circuit with an air interface to a quadridge feed structure to excite an antenna, such as a stacked patch antenna. Embodiments of the assembly can provide enhanced bandwidth, scan angle performance, and coincident phase centers for dual-linear polarizations.

19 Claims, 9 Drawing Sheets

RADIATOR HAVING A RIDGED FEED STRUCTURE

BACKGROUND

As is known in the art, a plurality of antenna elements can be disposed to form an array antenna. It is often desirable to utilize antenna elements capable of receiving orthogonally polarized radio frequency (RF) signals. Such antenna elements include, for example, four arm, dual polarized current sheet antenna elements, such as tightly coupled dipole array (TCDA), planar ultrawideband modular antenna (PUMA), and other known current sheet radiators. These radiator elements rely on polarization-aligned coupling to maintain their polarization scan performance over the scan volume, particularly at large scan angles.

Conventional radiators may not achieve certain desired performance characteristics. For example, PUMA radiators are low profile compared to other types of radiators, but are not coincident phase-centered elements. TCDAs may be relatively costly and are not as low profile as desired. Known current loop radiators are typically single ended and do not provide coincident phase-centered elements.

Some conventional elements require a coaxial feed with a shorting pin to eliminate the need for a balun and may have coincident orthogonal polarization phase centers. Other elements include a PWB coaxial feed with integrated power divider to eliminate baluns and have coincident orthogonal polarization phase centers. Planar Ultra-Wideband Modular Antenna (PUMA) Elements include unbalanced coaxial feeds with shorting vias to eliminate baluns and provide offset orthogonal polarization phase centers.

SUMMARY

Embodiments of the disclosure provide method and apparatus for an antenna structure, such as a stacked patch antenna, embedded in a cavity with a quadridge feed structure. In embodiments, the antenna structure can include an integral radome. Embodiments of the antenna structure may provide wide bandwidth, wide scan angle performance, triangular or square lattice structure, and modular construction. In embodiments, a cavity is formed in an aluminum structure. Coincident phase centers can be provided between dual-linear polarizations.

In one aspect, a radiator assembly comprises: a feed circuit; waveguides including ridges extending into the waveguides, wherein the waveguides have an air interface to the feed circuit; and an antenna to receive signals from the ridged waveguides wherein the ridged waveguides provide impedance matching between the feed circuit and the antenna.

An assembly can include one or more of the following features: the antenna comprises a stacked patch antenna, a housing having a cavity in which the antenna is embedded, the housing comprises an electrically conductive material to support electromagnetic propagation and thermal management, the housing provides thermal connectivity to dissipate heat, the ridges have a rectangular shape, a surface of at least one of the ridges includes a non-linear surface, the ridges have at least one step formed on respective surfaces of the ridges, the at least one step changes a distance that the ridge extends into the waveguide, the assembly includes coincident phase centers for first and second polarizations, and/or the assembly has a triangular lattice structure, a radome integrated with the assembly.

In another aspect, a method of providing a radiator assembly comprises: employing a feed circuit; employing waveguides including ridges extending into the waveguides, wherein the waveguides have an air interface to the feed circuit; and employing an antenna to receive signals from the ridged waveguides, wherein the ridged waveguides provide impedance matching between the feed circuit and the antenna.

A method can further include one or more of the following features: the antenna comprises a stacked patch antenna, employing a housing having a cavity in which the antenna is embedded, wherein the housing comprises an electrically conductive material to support electromagnetic propagation and thermal management, the housing provides thermal connectivity to dissipate heat, a surface of at least one of the ridged waveguides includes a non-linear surface, a surface of at least one of the ridged waveguides has at least one step formed on respective surfaces of the ridges, and/or the assembly includes coincident phase centers for first and second polarizations.

BRIEF DESCRIPTION OF THE DRAWINGS

The concepts, structures, and techniques sought to be protected herein may be more fully understood from the following detailed description of the drawings, in which.

DETAILED DESCRIPTION

Figure 1:
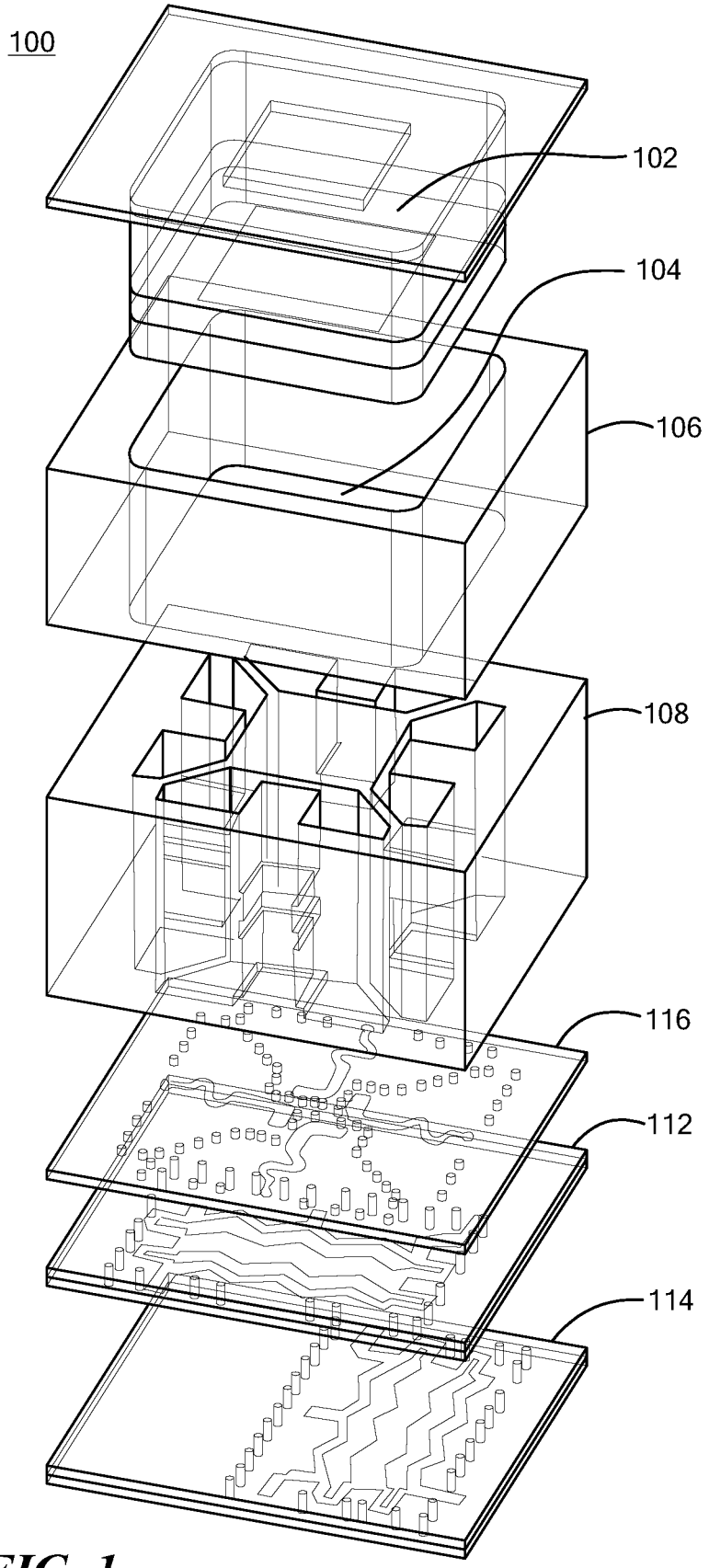
FIG. 1 is a semi-transparent exploded isometric view of a radiator having a quadridge feed structure in accordance with example embodiments of the disclosure.

FIG. 1 shows an exploded isometric view of an example antenna assembly 100 including an antenna structure 102, such as a stacked patch antenna, that can be embedded in a cavity 104 in a conductive structure 106, such as aluminum, disposed over a feed structure 108, such as a quadridge feed structure, coupled to a feed circuit 110 via a contactless air interface. In embodiments, the feed circuit 110 includes a first circuit 112 for a first polarization, a second circuit 114 for a second polarization, and an interface circuit 116 for launching signals into the feed structure 108. In embodiments, a feed circuit card assembly can include the first, second, and interface circuitry 112, 114, 116. The polarizations can be dual linear with coincident phase centers. In embodiments, the antenna assembly can have square, triangular, or other practical lattice configuration.

Figure 2:
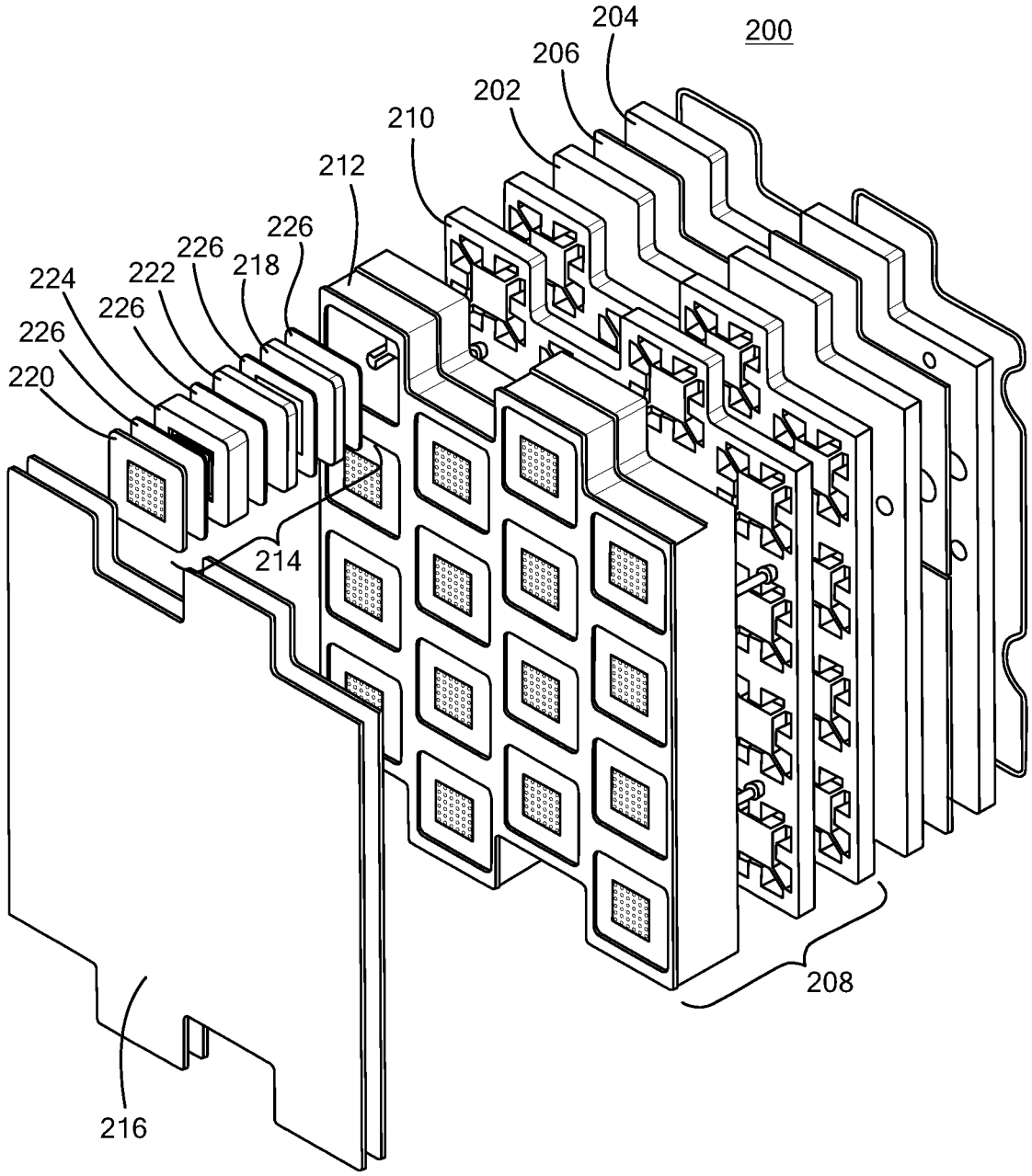
FIG. 2 is a partially exploded isometric view of a radiator having a quadridge feed structure in accordance with example embodiments of the disclosure.

FIG. 2 shows an example stack up for an antenna assembly 200 in accordance with illustrative embodiments of the disclosure. A feed circuit card assembly 202 is supported by a mounting plate 204 with a thermal interface layer 206 therebetween. A housing 208 can include a number of layers some of which provide an impedance-matching ridged feed structure 210 and some of which provide a cavity 212 for an embedded antenna 214, as shown and described more fully below. A radome 216 can be provided over the antenna 214. In embodiments, the housing 208 includes thermal connectivity to provide heat dissipation.

In an example embodiment, the antenna 214 includes a stack patch configuration having a first patch 218 separated from a second patch 220 by a dielectric layer 222 and spacer 224. In embodiments, the spacer 224 is formed from a foam material. In embodiments, a series of adhesive film layers 226 can secure various components in position. The antenna 214 is positioned in the cavity 212 of the housing. In embodiments, the housing layers are brazed to achieve the desired characteristics.

Figure 3A:
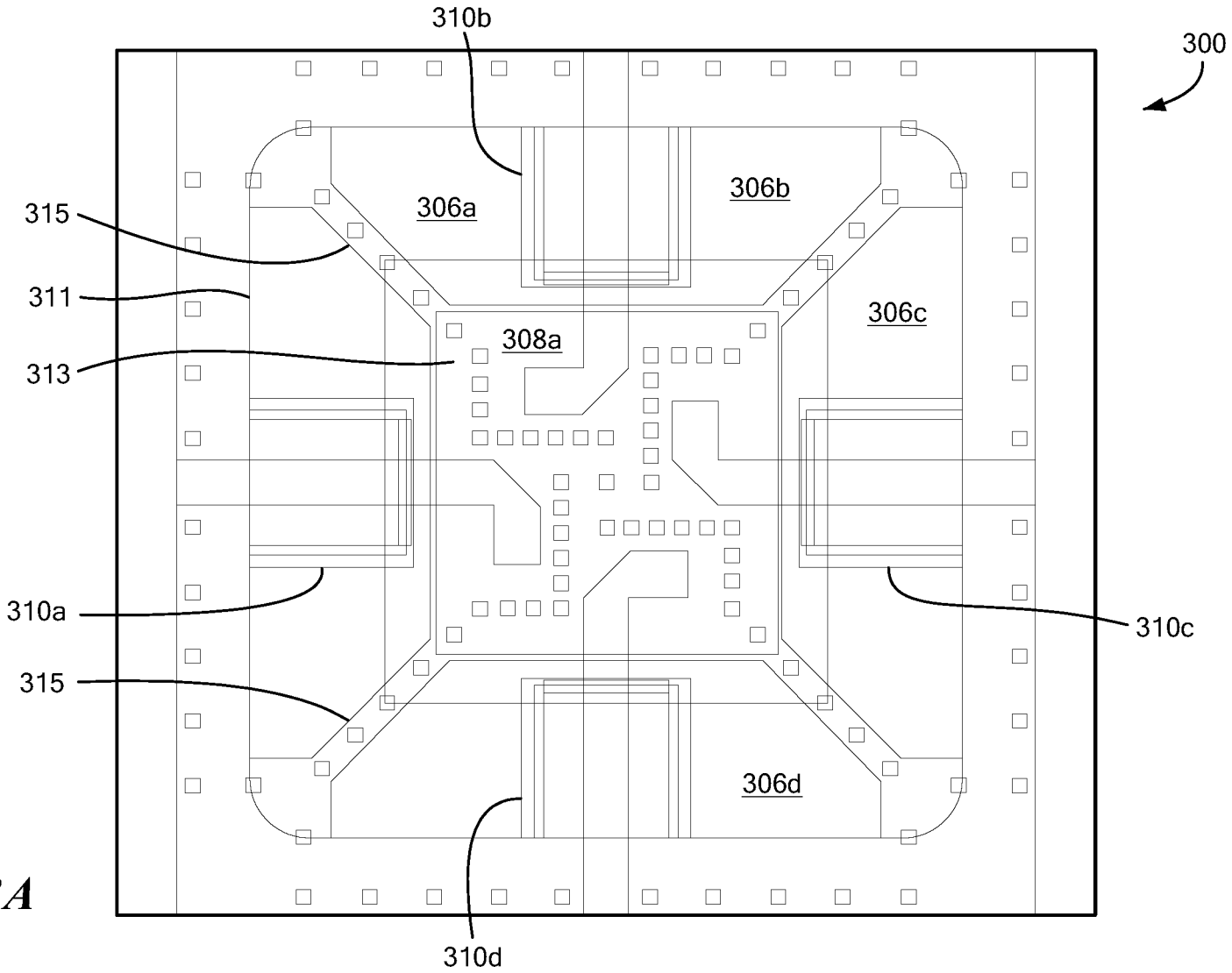
FIG. 3A is a semi-transparent top view.
Figure 3B:
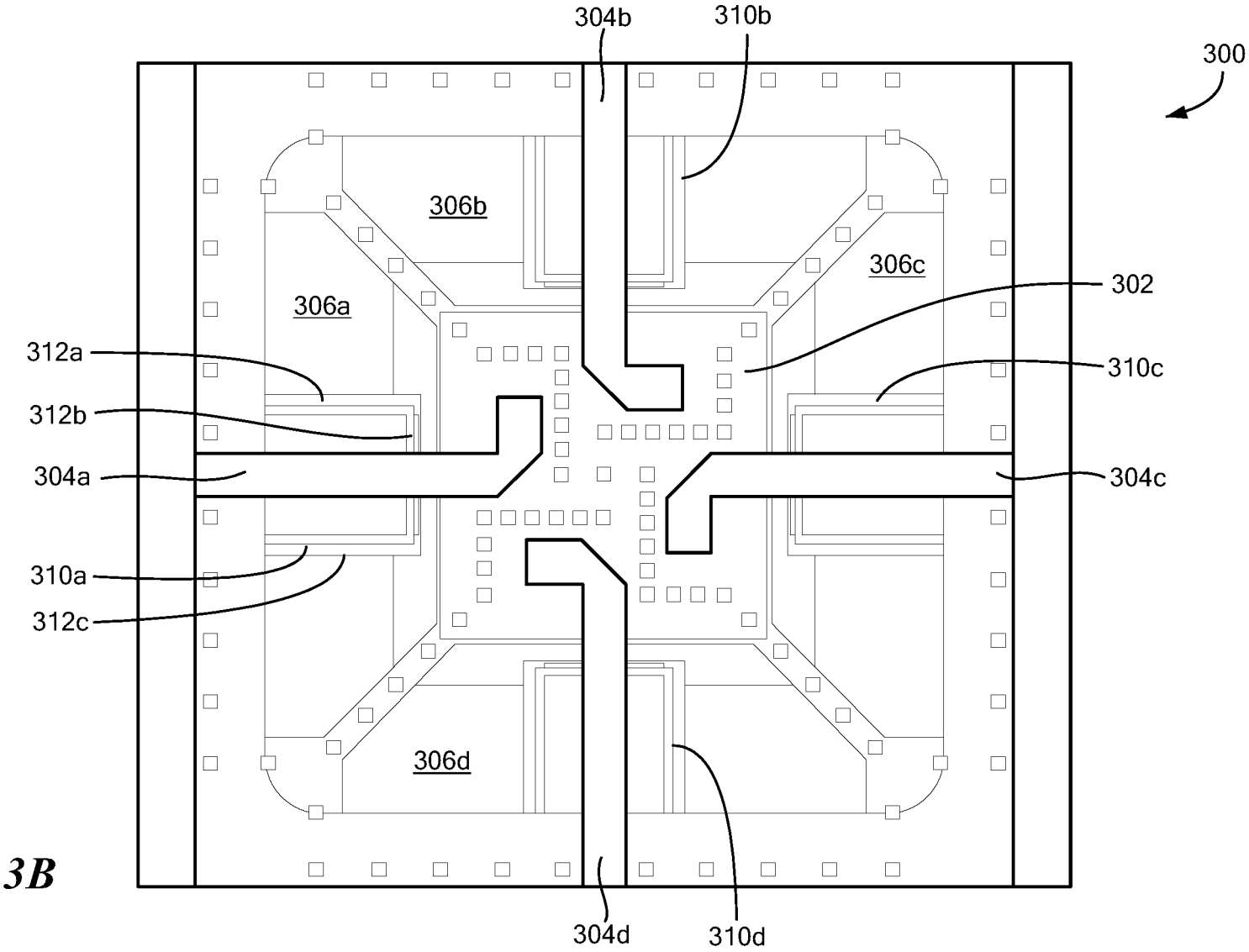
FIG. 3B is a semi-transparent bottom view.
Figure 3C:
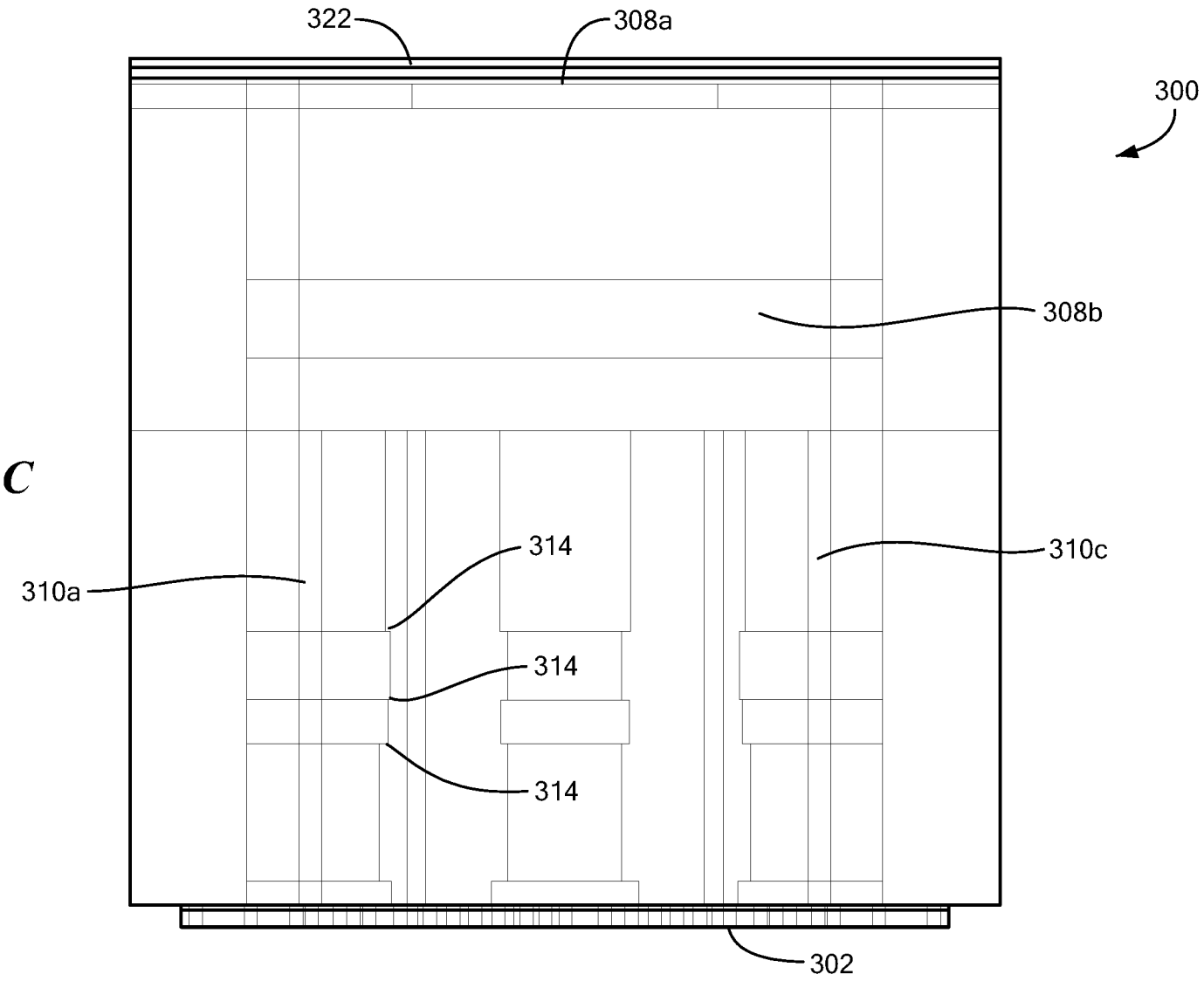
FIG. 3C is a semi-transparent side view of a radiator having a quadridge feed structure in accordance with example embodiments of the disclosure.

FIGS. 3A, 3B, and 3C shows an example ridged feed structure 300 in accordance with example embodiments of the disclosure. FIG. 3A is a top view, FIG. 3B is a bottom view, and FIG. 3C is side view, all of which are partially transparent, showing the example quadridge feed structure 300. A feed circuit 302 includes first, second, third, and fourth feed lines 304*a-d* that provide signals for the selected polarization. The feed lines 304 are configured to launch the signals into the ridged waveguides 306*a-d* via an air interface and excite an antenna, such as a stacked patch antenna having first and second patches 308*a,b*. That is, the feed lines 304 do not contact the waveguides.

A first waveguide 306*a* is formed in a conductive material from a feed circuit-end to an antenna-end to contain the signal until it exits the waveguide to excite the antenna 308. In the illustrated embodiment, the first waveguide 306*a* includes a ridge 310*a* that extends into the waveguide 306*a*. The first waveguide 306*a* provides impedance matching for the feed circuit 302 and the antenna 308.

As best seen in FIG. 3C, focusing on example first ridge 310*a*, a non-linear surface provides impedance matching. In an example embodiment, the first ridge 310*a* is rectangular where three sides 312*a,b,c* of the rectangle extend into the first waveguide. At least one of the sides 312 is non-linear. In an example embodiment, the sides 312*a-c* of the first ridge 310*a* include a series of steps 314 that modify the distance that the ridge extends into the waveguide. It is understood that the geometry of the ridge sides 312*a-c* are formed to provide impedance matching for the antenna 308 and the feed circuit 302.

In the illustrated embodiments, the waveguides 306 are defined by a wall 311 from which the ridges 310 extends, an opposing wall 313, and diagonal walls 315. In an example embodiment, the ridged waveguide is chamfered with a 36 mil ridge gap at launch and the diagonal walls 315 are 64 mils thick.

It is understood that the ridged waveguides are sized for selected wavelengths, signal propagation characteristics, etc. While example dimensions may be shown and/or described, it is understood that the particular geometry of the waveguides 306, waveguide surfaces, and waveguide lengths, for example, can vary to meet the needs of a particular application.

Figure 3D:
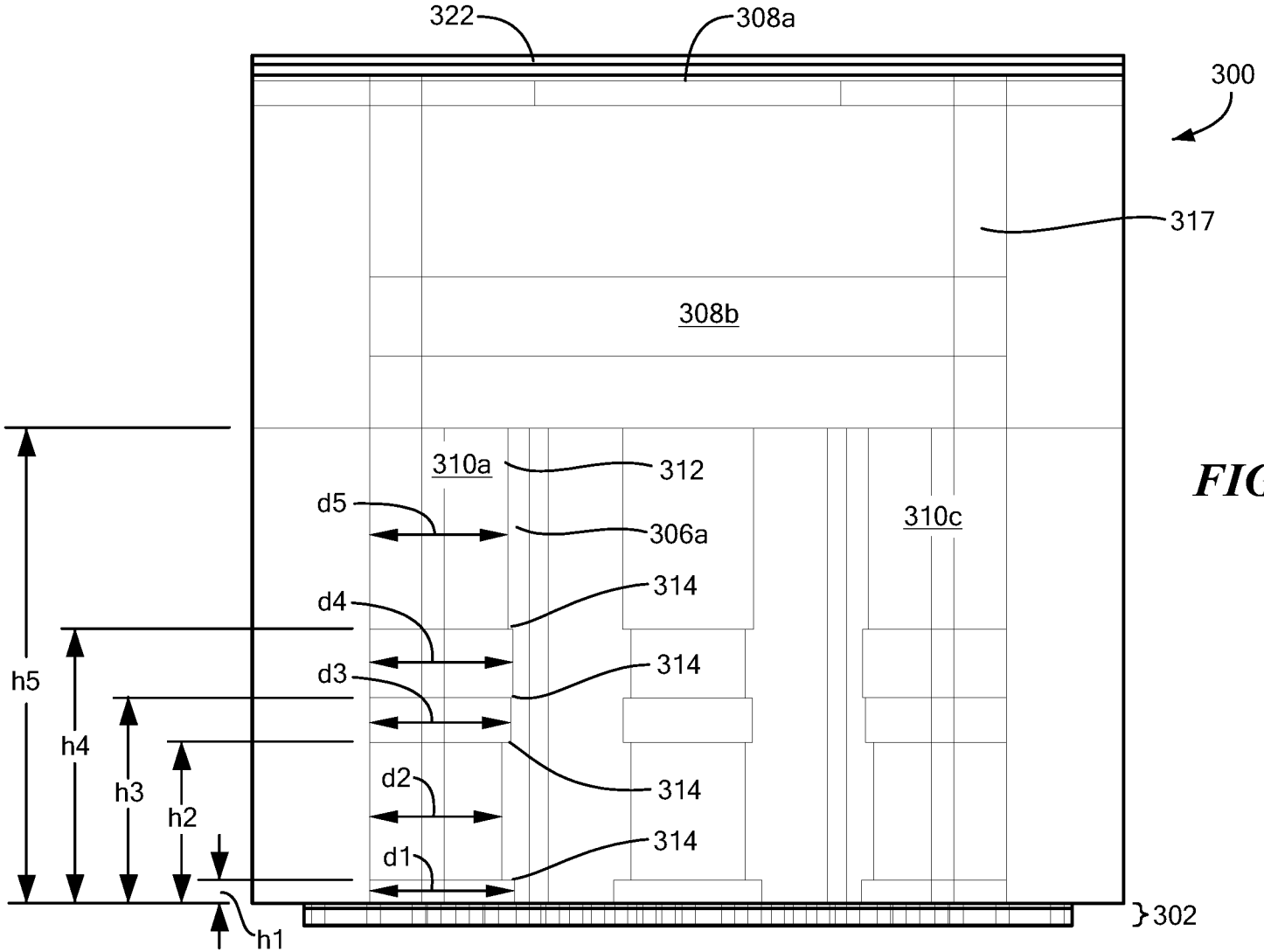
FIG. 3D shows further details of FIG. 3C.

Referring now to FIG. 3D which shows additional detail of the waveguide surfaces, the first ridge 310*a* extends a first distance d1 into the first waveguide 306*a* up to a first height h1 which is proximate the feed circuit 302, a second distance d2 into the waveguide up to a second height h2, a third distance d3 into the waveguide up to a third height h3, a fourth distance d4 into the waveguide up to a fourth height h4, and a fifth distance into the waveguide up to a fifth height h5.

The ridged waveguides 306 end proximate the antenna element 308 which is embedded in a cavity 317 in the housing. In the illustrated embodiment, the ridged waveguides 306 extend near a first patch 308*b* of a stacked patch antenna, which also has a second patch 308*b* spaced from the first patch. As described above, the patch antenna elements 308 are embedded in a cavity 318 formed in a conductive material 320, such as aluminum. A radome 322 can cover the antenna.

Example embodiments of the disclosure are shown having a stacked patch antenna configuration. In other embodiments, other types of antenna types can be used to meet the needs of a particular application.

As used herein, waveguides refer to structure having walls that limit electromagnetic wave propagation to one direction with minimal loss of energy. It is understood that without a waveguide, wave amplitudes decrease as they expand into three-dimensional space. Waveguides for RF signals have conductive walls to guide microwave signals. The geometry of a waveguide, e.g., size, shape, etc., determines the propagation characteristics of the signals. A waveguide may be described by a transmission line having a length and characteristic impedance such that the impedance indicates a ratio of voltage to current of the waveguide during propagation of the wave. The impedance ratio determines how much of the wave is transmitted forward and how much is reflected. In connecting a waveguide to an antenna impedance matching is performed since complete signal transmission is desirable. That is, an impedance mismatch results in a reflected wave that creates a standing wave that may be quantified by a voltage standing wave ratio (VSWR).

A ridged waveguide refers to a waveguide in which one or more ridges protrude into the center of the waveguide parallel to the short wall where the E-field is maximum. A ground down the ridge is required to propagate the E-field. Ridged waveguides can have any suitable geometry, such as rectangular, circular, etc. Suitable geometries should consider the room available for the feed layer transform and clearance to ensure mode propagation in the ridge guides.

Figure 4:
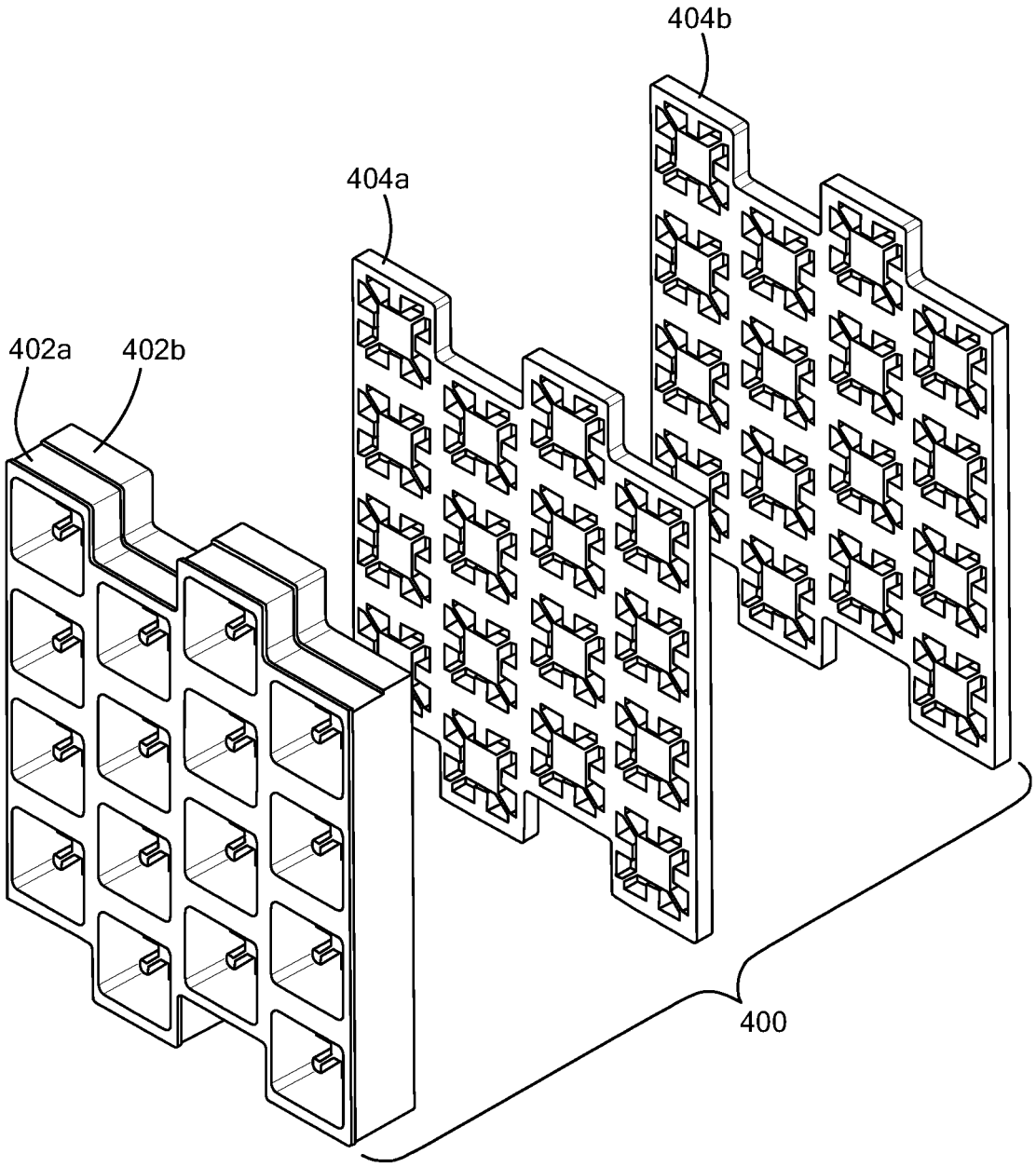
FIG. 4 is an exploded view of layers of a housing of a radiator having a quadridge feed structure in accordance with example embodiments of the disclosure.

FIG. 4 shows an example fabrication process for a housing 400 in which layers 402*a,b* of the cavity material and layers 404*a,b* having waveguide ridge surfaces can be formed. In the illustrated embodiment, first and second layers 402*a,b* of the conductive material containing the cavity can be formed and brazed together. The conductive material can comprise aluminum or other suitable conductive material. Layers 404*a,b* of the ridged waveguide can be undercut, for example, and joined together to form the desired ridge surface, such as the first waveguide ridge 308*a* of FIG. 3D. It is understood that any practical number of layers can be used for the housing to meet the needs of a particular application.

Figure 5:
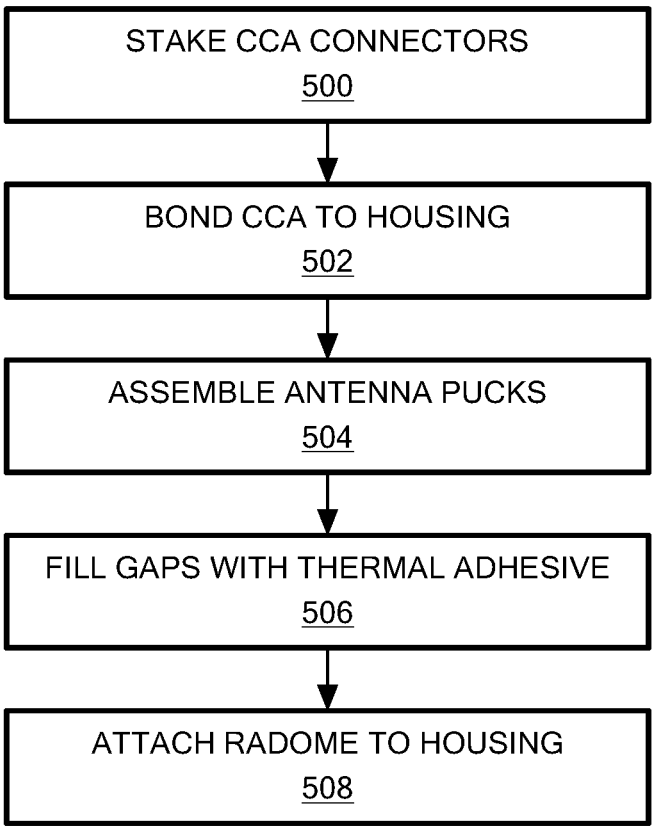
FIG. 5 is a flow diagram of an example sequence of steps for providing a radiator having a quadridge feed structure in accordance with example embodiments of the disclosure.

FIG. 5, in conjunction with FIG. 2, shows an example sequence of steps to form a radiator in accordance with example embodiments of the disclosure. In step 500, circuit card assembly connectors for the feed circuit can staked. In step 502, the circuit card assembly can be laminated to the aluminum housing that includes the 'eggcrates.' In step 504, antenna patch pucks are bonded to the assembly and embedded in the respective cavities. In example embodiments, a patch puck includes an upper antenna patch 220 and a lower antenna patch 218 with foam 224 between the patches.

Adhesive layers 226 can be used as shown in FIG. 2. In step 506, any gaps, such as edges of the upper patch, can be filled with a thermal adhesive. In step 508, a radome can be laminated to the housing.

Figure 6:
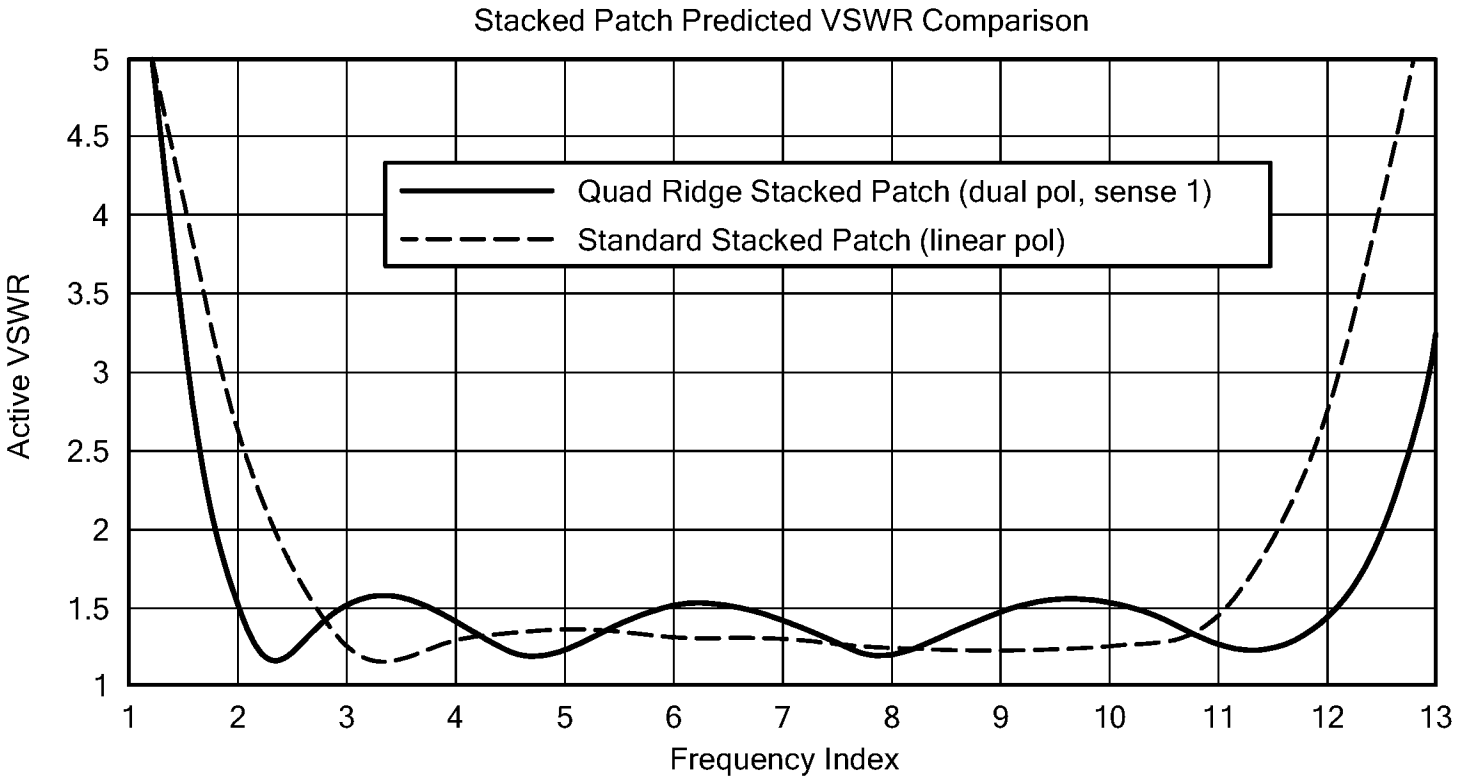
FIG. 6 is a plot comparing a performance of a radiator having a quadridge feed structure in accordance with example embodiments of the disclosure with a conventional single polarization radiator.

FIG. 6 shows example performance of a radiator in accordance with example embodiments of the disclosure compared with a conventional single polarization stacked patch antenna in terms of active VSWR (voltage standing wave ratio). The illustrative plot compares a conventional single polarization stacked patch radiator to an example embodiment of a dual-polarization quadridge radiator in terms of active VSWR along a frequency index for a boresight scan. As can be seen, the cavity structure and integrated radome provide the inventive quadridge radiator with about a 20 percent bandwidth improvement over a conventional stacked patch radiator.

Various embodiments of the concepts systems and techniques are described herein with reference to the related drawings. Alternative embodiments can be devised without departing from the scope of the described concepts. It is noted that various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. As an example of an indirect positional relationship, references in the present description to element or structure "A" over element or structure "B" include situations in which one or more intermediate elements or structures (e.g., element "C") is between element "A" and element "B" regardless of whether the characteristics and functionalities of element "A" and element "B" are substantially changed by the intermediate element(s).

The following definitions and abbreviations are to be used for the interpretation of the claims and the specification.

As used herein, the terms "comprises," "comprising," "includes," "including," "has," "having," "contains" or "containing," or any other variation thereof, are intended to cover a non-exclusive inclusion. For example, a method, article, or apparatus that comprises a list of elements is not necessarily limited to only those elements but can include other elements not expressly listed or inherent to such method, article, or apparatus.

Additionally, the term "exemplary" is used herein to mean "serving as an example, instance, or illustration." Any embodiment or design described herein as "exemplary" is not necessarily to be construed as preferred or advantageous over other embodiments or designs. The terms "one or more" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection".

References in the specification to "one embodiment," "an embodiment," "an example embodiment," or variants of such phrases indicate that the embodiment described can include a particular feature, structure, or characteristic, but every embodiment can include the particular feature, structure, or characteristic. Moreover, such phrases are not necessarily referring to the same embodiment. Further, when a particular feature, structure, or characteristic is described in connection knowledge of one skilled in the art to affect such feature, structure, or characteristic in connection with other embodiments whether or not explicitly described.

Furthermore, it should be appreciated that relative, directional or reference terms (e.g. such as "above," "below," "left," "right," "top," "bottom," "vertical," "horizontal," "front," "back," "rearward," "forward," etc.) and derivatives thereof are used only to promote clarity in the description of the figures. Such terms are not intended as, and should not be construed as, limiting. Such terms may simply be used to facilitate discussion of the drawings and may be used, where applicable, to promote clarity of description when dealing with relative relationships, particularly with respect to the illustrated embodiments. Such terms are not, however, intended to imply absolute relationships, positions, and/or orientations. For example, with respect to an object or structure, an "upper" surface can become a "lower" surface simply by turning the object over. Nevertheless, it is still the same surface and the object remains the same. Also, as used herein, "and/or" means "and" or "or", as well as "and" and "or." Moreover, all patent and non-patent literature cited herein is hereby incorporated by references in their entirety.

The terms "disposed over," "overlying," "atop," "on top," "positioned on" or "positioned atop" mean that a first element, such as a first structure, is present on a second element, such as a second structure, where intervening elements or structures (such as an interface structure) may or may not be present between the first element and the second element. The term "direct contact" means that a first element, such as a first structure, and a second element, such as a second structure, are connected without any intermediary elements or structures between the interface of the two elements.

Having described exemplary embodiments, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

Elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

What is claimed is:

1. A radiator assembly, comprising:

a feed circuit;

waveguides including ridges extending into the waveguides, wherein the waveguides have an air interface to the feed circuit;

an antenna to receive signals from the ridged waveguides wherein the ridged waveguides provide impedance matching between the feed circuit and the antenna; and a housing having a cavity in which the antenna is embedded.

2. The assembly according to claim 1, wherein the antenna comprises a stacked patch antenna.

3. The assembly according to claim 1, wherein the housing comprises an electrically conductive material to support electromagnetic propagation and thermal management.

4. The assembly according to claim 1, wherein the housing provides thermal connectivity to dissipate heat.

5. The assembly according to claim 1, wherein the ridges have a rectangular shape.

6. The assembly according to claim 5, wherein a surface of at least one of the ridges includes a non-linear surface.

7. The assembly according to claim 1, wherein the ridges have at least one step formed on respective surfaces of the ridges.

8. The assembly according to claim 7, wherein the at least one step changes a distance that the ridge extends into the waveguide.

9. The assembly according to claim 1, wherein the assembly includes coincident phase centers for first and second polarizations.

10. The assembly according to claim 1, wherein the assembly has a triangular lattice structure.

11. The assembly according to claim 1, further including a radome integrated with the assembly.

12. A method of providing a radiator assembly, comprising:

employing a feed circuit;

employing waveguides including ridges extending into the waveguides, wherein the waveguides have an air interface to the feed circuit;

employing an antenna to receive signals from the ridged waveguides, wherein the ridged waveguides provide impedance matching between the feed circuit and the antenna; and employing a housing having a cavity in which the antenna is embedded.

13. The method according to claim 12, wherein the antenna comprises a stacked patch antenna.

14. The method according to claim 12, wherein the housing comprises an electrically conductive material to support electromagnetic propagation and thermal management.

15. The method according to claim 14, wherein the housing provides thermal connectivity to dissipate heat.

16. The method according to claim 15, wherein a surface of at least one of the ridged waveguides includes a non-linear surface.

17. The method according to claim 16, wherein a surface of at least one of the ridged waveguides has at least one step formed on respective surfaces of the ridges.

18. The method according to claim 12, wherein the assembly includes coincident phase centers for first and second polarizations.

19. A radiator assembly, comprising:

a means for generating feed signals;

a means for guiding waves including ridges and an air interface to the means for generating feed signals;

an antenna means for receiving signals from the means for guiding waves wherein the means for guiding waves provides impedance matching between the feed circuit and the antenna means; and a housing having a cavity in which the antenna means is embedded.

* * * * *